US010319320B2

(12) United States Patent
Kim et al.

(10) Patent No.: US 10,319,320 B2
(45) Date of Patent: Jun. 11, 2019

(54) DISPLAY DEVICE AND METHOD OF DRIVING THE SAME

(71) Applicant: SAMSUNG DISPLAY CO., LTD., Yongin-si (KR)

(72) Inventors: Jung-Won Kim, Seoul (KR); Jae-Sung Bae, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 367 days.

(21) Appl. No.: 15/053,561

(22) Filed: Feb. 25, 2016

(65) Prior Publication Data

US 2017/0018240 A1 Jan. 19, 2017

(30) Foreign Application Priority Data

Jul. 13, 2015 (KR) ..... 10-2015-0099091

(51) Int. Cl.
*G09G 3/36* (2006.01)

(52) U.S. Cl.
CPC ... *G09G 3/3648* (2013.01); *G09G 2320/0673* (2013.01)

(58) Field of Classification Search
CPC ..... G09G 2320/0673; G09G 3/3648
See application file for complete search history.

(56) References Cited

U.S. PATENT DOCUMENTS

2006/0208983 A1* 9/2006 Lee ..... G09G 3/3648 345/89
2010/0007639 A1* 1/2010 Jeong ..... G09G 3/2007 345/208
2013/0321483 A1* 12/2013 You ..... G09G 5/10 345/690
2014/0002509 A1* 1/2014 Kim ..... G09G 3/003 345/690
2014/0049713 A1* 2/2014 No ..... G02F 1/13306 349/41
2016/0232860 A1* 8/2016 Kim ..... G09G 3/2022
2016/0275843 A1* 9/2016 Shin ..... G09G 3/3614

FOREIGN PATENT DOCUMENTS

JP 11-024634 1/1999
KR 1020130134567 12/2013

* cited by examiner

*Primary Examiner* — Dmitriy Bolotin
(74) *Attorney, Agent, or Firm* — F. Chau & Associates, LLC

(57) ABSTRACT

A display device includes a memory, a gray voltage generator, a signal controller, a data driver and a display panel, where the pixels are driven by a first driving data comprising first data which arranges a first image based on the first gamma curve and a second image based on the second gamma curve to each pixel, and a second driving data comprising second data which arranges the first image and the second image to each pixel with a different arrangement as the first data.

10 Claims, 15 Drawing Sheets

DISPLAY DEVICE AND METHOD OF DRIVING THE SAME

CROSS-REFERENCE TO RELATED APPLICATIONS

This application claims priority under 35 U.S.C. § 119 to Korean Patent Application No. 10-2015-0099091, filed on Jul. 13, 2015 in the Korean Intellectual Property Office (KIPO), the contents of which are herein incorporated by reference in their entireties.

FIELD

The present inventive concept relates to a display device and to a method of driving the display device. More particularly, the present inventive concept relates to a display device and method for high display quality.

DISCUSSION OF RELATED ART

A display device, such as a liquid crystal display ("LCD") or an organic light emitting diode ("OLED") display, generally includes a display panel including a plurality of pixels each having a switching element, a plurality of signal lines, a gray voltage generator that generates a gray reference voltage, and a data driver that generates a plurality of gray voltages using the gray reference voltage and applies the gray voltage corresponding to an input image signal among the generated gray voltages as a data signal to a data line.

The LCD typically includes two parallel display panel parts having pixel electrodes and an opposing electrode, respectively, and a liquid crystal layer having dielectric anisotropy interposed therebetween. The pixel electrodes are arranged in a matrix form and each connected to a corresponding switching element such as a thin film transistor ("TFT") to sequentially receive the data voltages row by row. The opposing electrode is disposed through substantially the entire surface of the display panel and receives a common voltage. The pixel electrodes and the opposing electrode are applied with the voltages to generate an electric field in the liquid crystal layer such that the intensity of the electric field is controlled and transmittance of light passing through the liquid crystal layer is controlled, thereby obtaining a desired image. In the LCD, lateral visibility may be lower than frontal visibility.

SUMMARY

Exemplary embodiments of the present inventive concept provide a display device and driving method for high display quality.

In an exemplary embodiment of a display device according to the present inventive concept, the display device includes a memory configured to store gamma data corresponding to a plurality of gamma curves including a first gamma curve and a second gamma curve, a gray voltage generator configured to generate a plurality of gray voltages based on the gamma data, a signal controller configured to receive an input image signal, a data driver configured to receive the input image signal from the signal controller and convert the input image signal into a data voltage using the gray voltages and a display panel comprising a plurality of pixels configured to receive the data voltage and display an image. The pixels are driven by a first driving data comprising a first data which arranges a first image based on the first gamma curve and a second image based on the second gamma curve to each pixel, and a second driving data comprising a second data which arranges the first image and the second image to each pixel with a different arrangement as the first data.

In an exemplary embodiment, a luminance of the first image may be equal to or greater than a luminance of the second image.

In an exemplary embodiment, the pixels may display an image on a frame set basis. The frame set may include a first frame configured to display the first image to a first pixel and display the second to a second pixel according to the first driving data, a second frame configured to display the second image to the first pixel and display the first to the second pixel according to the second driving data and a plurality of transition frames disposed between the first frame and the second frame and configured to display a third image and a fourth image to the first pixel and the second pixel, a luminance of the third image and the fourth image is equal to or less than a luminance of the first image, and equal to or greater than a luminance of the second image.

In an exemplary embodiment, a gamma value of the third image may be defined by the following expression: $(x-n)/x\times GH+n/x\times GL$. A gamma value of the fourth image is defined by the following expression: $n/x\times GH+(x-n)/x\times GL$. The x may be the number of the transition frames, the n may be an order of the transition frames, the GH may be a gamma value of the first image and the GL may be a gamma value of the second image.

In an exemplary embodiment, the number of the transition frames may be 60.

In an exemplary embodiment, the number of the transition frames may be 120.

In an exemplary embodiment, the number of the transition frames may be 240.

In an exemplary embodiment, the pixels may be driven by a first driving data, and after the display panel has been off, when the display panel is on, the pixels may be driven by a second driving data.

In an exemplary embodiment, before the display panel is off, the first data of the first driving data concerning arrangement of the first image and the second image to each pixel may be stored, and a second driving data comprising a second data which arranges the first image and the second image to each pixel with an opposite arrangement as the first data may be generated.

In an exemplary embodiment, the first driving data and the second driving data may include a data which arranges the first image and the second image to each pixel randomly.

In an exemplary embodiment of method driving a display device including a memory configured to store gamma data corresponding to a plurality of gamma curves including a first gamma curve and a second gamma curve, a gray voltage generator configured to generate a plurality of gray voltages based on the gamma data, a signal controller configured to receive an input image signal, a data driver configured to receive the input image signal from the signal controller and convert the input image signal into a data voltage using the gray voltages and a display panel comprising a plurality of pixels configured to receive the data voltage and display an image, the method includes displaying an image according to a first driving data comprising a first data which arranges a first image based on the first gamma curve and a second image based on the second gamma curve to each pixel and displaying an image according to a second driving data comprising a second data which arranges the first image and the second image to each pixel with a different arrangement as the first data.

In an exemplary embodiment, a luminance of the first image may be equal to or greater than a luminance of the second image.

In an exemplary embodiment, the pixels may display an image on a frame set basis. The frame set may include a first frame configured to display the first image to a first pixel and display the second to a second pixel according to the first driving data, a second frame configured to display the second image to the first pixel and display the first to the second pixel according to the second driving data and a plurality of transition frames disposed between the first frame and the second frame and configured to display a third image and a fourth image to the first pixel and the second pixel, a luminance of the third image and the fourth image is equal to or less than a luminance of the first image, and equal to or greater than a luminance of the second image.

In an exemplary embodiment, a gamma value of the third image may be defined by the following expression: $(x-n)/x \times GH+n/x \times GL$. A gamma value of the fourth image is defined by the following expression: $n/x \times GH+(x-n)/x \times GL$. The x may be the number of the transition frames, the n may be an order of the transition frames, the GH may be a gamma value of the first image and the GL may be a gamma value of the second image.

In an exemplary embodiment, the number of the transition frames may be 60.

In an exemplary embodiment, the number of the transition frames may be 120.

In an exemplary embodiment, the number of the transition frames may be 240.

In an exemplary embodiment, the pixels may be driven by a first driving data, and after the display panel has been off, when the display panel is on, the pixels may be driven by a second driving data.

In an exemplary embodiment, before the display panel is off, the first data of the first driving data concerning arrangement of the first image and the second image to each pixel may be stored, and a second driving data comprising a second data which arranges the first image and the second image to each pixel with an opposite arrangement as the first data may be generated.

In an exemplary embodiment, the first driving data and the second driving data may include a data which arranges the first image and the second image to each pixel randomly.

According to the present exemplary embodiment, a method of driving display device according to the present inventive concept includes a plurality of transition frames disposed between a first frame and a second frame. A third image and a fourth image are displayed to the first pixel and the second pixel in the transition frames. A luminance of the third image and the fourth image is equal to or less than a luminance of the first image, and equal to or greater than a luminance of the second image. Therefore, a luminance of the pixels may be gradually translated from the first frame to the second frame. Thus, flickering of the display device may be substantially prevented.

In addition, the pixels are driven by a first driving data. In addition, after the display panel has been off, when the display panel is on, the pixels are driven by a second driving data. Therefore, whenever the display panel has been off, an arrangement of the first image and the second image to each pixel may be varied. Since an arrangement of the first image and the second image to each pixel is varied, each pixel does not display the same image long time. Thus, a residual voltage of each pixel may be uniform.

An exemplary embodiment method of displaying an image includes displaying a plurality of pixels using a corresponding plurality of first luminance values; displaying the plurality of pixels using a corresponding plurality of intermediate luminance values; and displaying the plurality of pixels using a corresponding plurality of second luminance values substantially different from the plurality of first luminance values, wherein the plurality of first luminance values are based on a first assigned correspondence of a plurality of gamma curves to the plurality of pixels, the plurality of intermediate luminance values are based on incremental steps between the first luminance values and the second luminance values, and the plurality of second luminance values are based on a second assigned correspondence of the plurality of gamma curves to the plurality of pixels.

An exemplary embodiment method may further include: storing, upon power-down, an indicator of the first and second assigned correspondences; retrieving, upon power-up, the indicator of the first and second assigned correspondences; and implementing, after power-up, first and second assigned correspondences based on the retrieved indicator that are different from the first and second assigned correspondences implemented prior to power-down.

An exemplary embodiment method may provide that the plurality of pixels comprise at least first and second bisected sub-pixels, and that the first and second bisected sub-pixels are displayed with different luminance values corresponding to different ones of the plurality of gamma curves, respectively.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION

Hereinafter, exemplary embodiments of the present inventive concept will be explained in detail with reference to the accompanying drawings.

Figure 1:
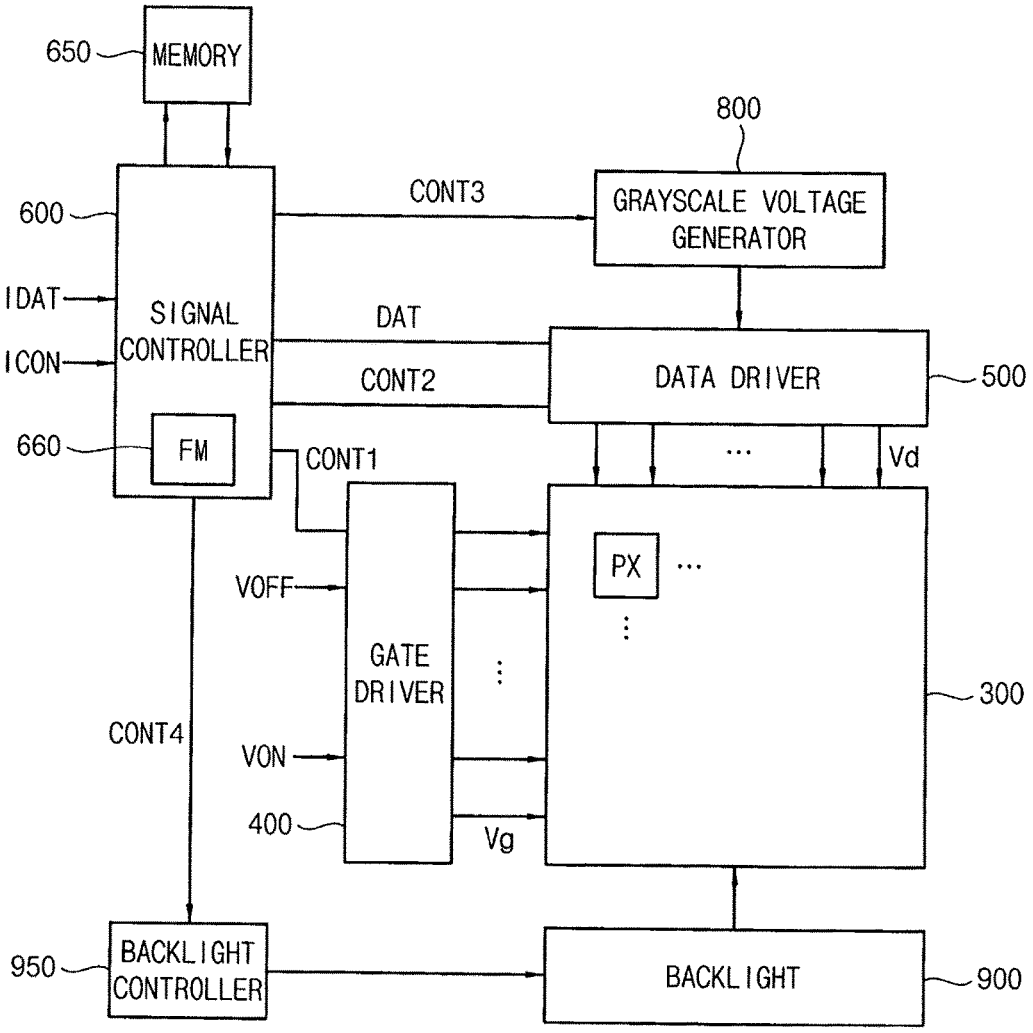
FIG. 1 is a block diagram illustrating a display device according to an exemplary embodiment of the inventive concept.

FIG. 1 is a block diagram illustrating a display device according to an exemplary embodiment of the inventive concept.

Referring to FIG. 1, a display device according to an exemplary embodiment of the inventive concept includes a display panel 300, a gate driver 400 and a data driver 500, each of which is connected to the display panel 300, a grayscale voltage generator 800 connected to the data driver 500, a signal controller 600 that controls the gate driver 400, the data driver 500 and the grayscale voltage generator 800, and a memory 650 connected to the signal controller 600.

In an exemplary embodiment, the display panel 300 includes a plurality of signal lines, and a plurality of pixels PX connected to the signal lines and arranged substantially in a matrix form. In an exemplary embodiment, where the display device is a liquid crystal display, the display panel 300 includes lower and upper panels (not shown) facing each other and a liquid crystal layer (not shown) interposed therebetween, when viewed from a cross-sectional view.

The signal lines include a plurality of gate lines (not shown) that transmit a gate signal (referred to as a "scanning signal") and a plurality of data lines (not shown) that transmit a data voltage.

The gate driver 400 is connected to the gate lines and applies a gate signal Vg having a gate-on voltage Von and a gate-off voltage Voff to the gate lines.

The memory 650 is connected to the signal controller 600, and stores gamma data for a gamma curve and then transmits the gamma data to the signal controller 600. The gamma curve is a curved line of a luminance or a transmittance for the grayscale levels of the input image signal IDAT, and gray voltages or reference gray voltages may be determined based on the gamma curve. The gamma data stored in the memory 650 may include gamma data for two different gamma curves. In an alternative embodiment, the memory 650 may be included in the signal controller 600, the grayscale voltage generator 800, and/or in the data driver 500.

The grayscale voltage generator 800 generates gray voltages for all grayscale levels or a predetermined number of reference gray voltages (hereinafter referred to as "reference gray voltages") related to transmittance of the pixels PX. The gray voltages or reference gray voltages may be positive or negative with respect to the common voltage. The grayscale voltage generator 800 may receive the gamma data from the signal controller 600 and generate the gray voltages or reference gray voltages based on the gamma data.

In an alternative exemplary embodiment of the inventive concept, the grayscale voltage generator 800 may be included in the data driver 500.

The data driver 500 is connected to the data line, selects a gray voltage among the gray voltages from the grayscale voltage generator 800, and applies the selected gray voltage to the data line as a data signal. In an exemplary embodiment, where the grayscale voltage generator 800 does not provide the gray voltage for all grayscale levels, but provides the predetermined number of reference gray voltages, the data driver 500 may generate gray voltages for all gray levels by dividing the reference gray voltages and then select a data signal among the divided reference gray voltages.

The signal controller 600 controls an operation of drivers, such as the gate driver 400 and the data driver 500, for example. The signal controller 600 may further include a frame memory ("FM") 660 that stores the input image signal IDAT by a frame unit.

As shown in FIG. 1, an alternative exemplary embodiment of the display device according to the inventive concept may further include a backlight unit 900 and a backlight controller 950 that provides light to the display panel 300.

The backlight controller 950 receives a backlight control signal CONT4 from the signal controller 600 to control the backlight unit 900. The backlight control signal CONT4 may include a pulse width modulation ("PWM") control signal for controlling a turn-on time of the partial or entire backlight unit 900.

Hereinafter, a display operation of the display device according to an exemplary embodiment of the inventive concept will be described.

The signal controller 600 receives an input image signal IDAT and an input control signal ICON for controlling display of an image corresponding to the input image signal IDAT from the outside. The input image signal IDAT has luminance information of each pixel PX, and the luminance corresponds to a predetermined number of grayscale levels, for example $1024=2^{10}$, $256=2^{8}$, or $64=2^{6}$. In an exemplary embodiment, the input control signal ICON may include a vertical synchronization signal, a horizontal synchronizing signal, a main clock signal and a data enable signal, for example.

The signal controller 600 processes the input image signal IDAT based on the input image signal IDAT and the input control signal ICON to convert the input image signal IDAT into an output image signal DAT, and generates a gate control signal CONT1, a data control signal CONT2 and a gamma control signal CONT3. The signal controller 600 outputs the gate control signal CONT1 to the gate driver 400, the data control signal CONT2 and the output image signal DAT to the data driver 500, and the gamma control signal CONT3 to the grayscale voltage generator 800.

The gamma control signal CONT3 may include the gamma data stored in the memory 650.

As shown in FIG. 1, in an exemplary embodiment where the display device further includes the backlight unit 900 and the backlight controller 950, the signal controller 600 further generates and outputs a backlight control signal CONT4 to the backlight controller 950.

The grayscale voltage generator 800 generates and outputs the gray voltages or the predetermined number of reference gray voltages to the data driver 500 based on the gamma control signal CONT3. The gray voltages may be respectively provided for the different gamma curves, and the gray voltages may be generated for a gamma curve selected through a separate process.

The data driver 500 receives the output image data DAT, which may be in a digital form for the pixels PX of a pixel row based on the data control signal CONT2 from the signal controller 600 and selects the gray voltage corresponding to each output image data DAT to convert the output image data DAT into the analog data voltage Vd, and then applies the converted analog data voltage to the corresponding data lines.

The gate driver 400 applies the gate-on voltage Von to the gate lines based on the gate control signal CONT1 from the signal controller 600 to turn on the switching element connected to the gate lines. The data voltage supplied to the data lines is supplied to a corresponding pixel PX through the turned-on switching element. When the pixel PX is applied with the data voltage, the pixel PX may display the luminance corresponding to the data voltage through various optical conversion elements. In one exemplary embodiment, for example, where the display device is the liquid crystal display, an inclination degree of the liquid crystal molecules of the liquid crystal layer is controlled to control polarization of light, thereby displaying the luminance corresponding to the grayscale level of the input image signal IDAT. In such an embodiment, the partial or entire backlight unit 900 is turned on or turned off based on the control of the backlight controller 950, thereby providing light to the display panel 300.

By repeating the process described above, which may be a process in a unit of one horizontal period (also written as "1H" that is the same as one period of the horizontal synchronizing signal and the data enable signal), the gate-on voltage Von is sequentially applied to the plurality of gate lines to apply the data signal to the plurality of pixels PX, thereby displaying images of one frame.

When one frame ends, the next frame starts, and a state of the inversion signal applied to the data driver 500 may be controlled such that the polarity of the data signal applied to each pixel PX is inverted or otherwise changed to be opposite to a polarity of the previous frame ("frame inversion"). The polarity of the data voltage Vd applied to all pixels PX may be inverted every one or more frame(s) in the frame inversion. In an exemplary embodiment, the polarity of the image data voltage flowing through one of the data lines is changed based on the characteristics of the inversion signal even within one frame, or the polarities of the data voltage Vd applied to the data lines of one pixel PX row may be different from each other.

Figure 2:
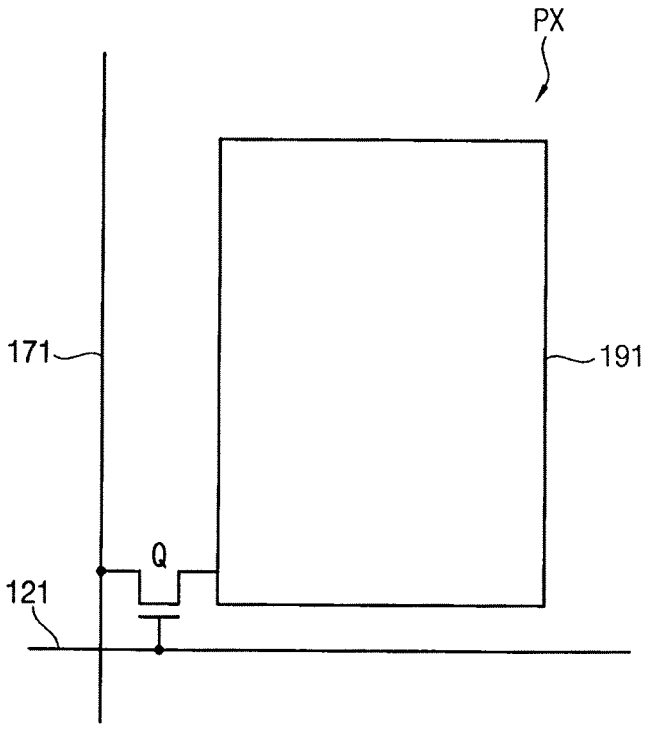
FIG. 2 is a circuit diagram illustrating a pixel of a display device according to an exemplary embodiment of the inventive concept.
Figure 3:
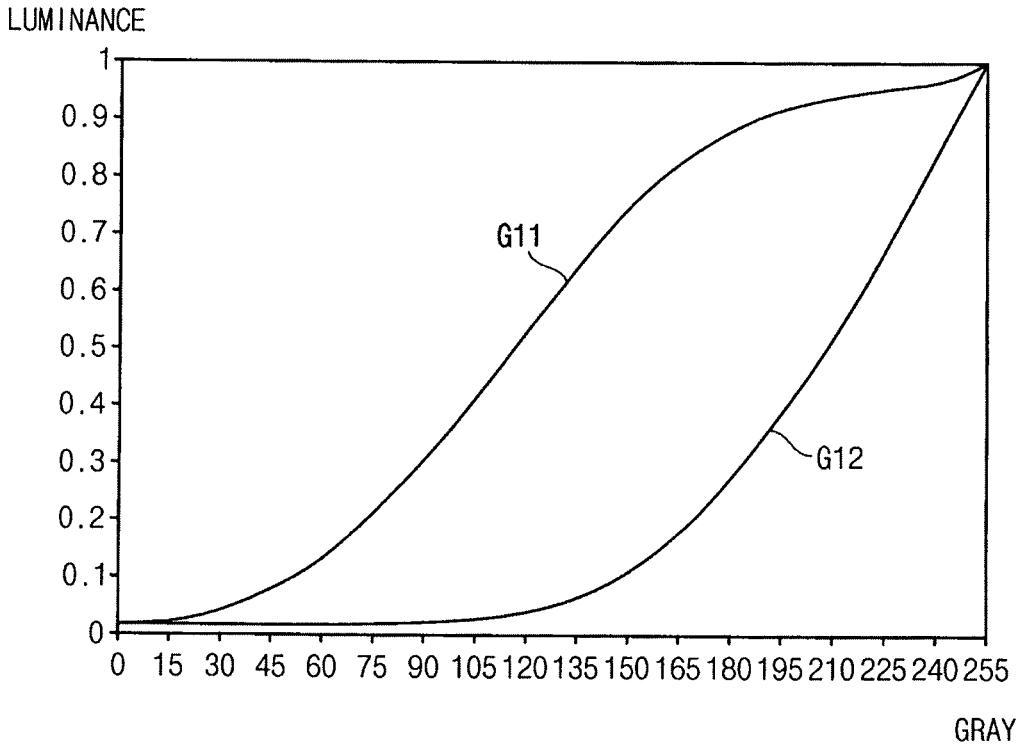
FIG. 3 is a graphical diagram illustrating a gamma curve of a display device according to an exemplary embodiment of the inventive concept.

FIG. 2 is a circuit diagram illustrating a pixel of a display device according to an exemplary embodiment of the inventive concept. FIG. 3 is a graph illustrating a gamma curve of a display device according to an exemplary embodiment of the inventive concept.

Referring to FIG. 2, a pixel PX of an exemplary embodiment of the display device according to the inventive concept may include a switching element Q connected to a data line, e.g., a data line 171, and at least one gate line, e.g., a gate line 121, and a pixel electrode 191 connected to the switching element Q.

The switching element Q may include a thin film transistor, and is controlled according to the gate signal Vg transmitted by the gate line 121, thereby transmitting the data voltage Vd transmitted by the data line 171 to the pixel electrode 191.

In an exemplary embodiment, referring to FIG. 3, the gamma data may include the gamma data for the first gamma curve G11 and the second gamma curve G12. In such an embodiment, the luminance of the image based on the first gamma curve G11 may be equal to or higher than the luminance of the image based on the second gamma curve G12.

Figure 4:
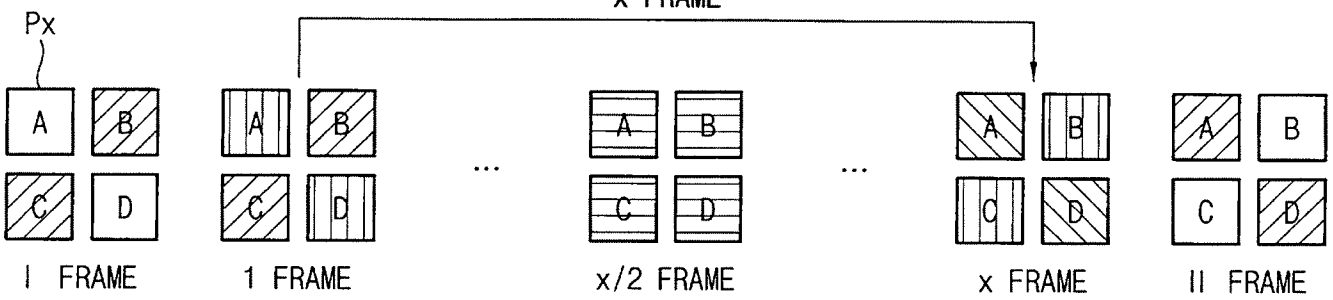
FIG. 4 is a diagram illustrating a luminance of pixels of a display device according to an exemplary embodiment of the inventive concept.

FIG. 4 is a view illustrating a luminance of pixels of a display device according to an exemplary embodiment of the inventive concept.

To increase lateral visibility relative to frontal visibility, one pixel may be bisected into two sub-pixels with different voltages applied thereto. When one pixel is divided into two sub-pixels, the opening area for passing light may decrease such that transmittance may be low. An undivided or non-division pixel may be used to increase transmittance. When a Spatial Gamma Mixing (SGM) pixel driving method is applied to the non-division pixel, the residual voltage of each pixel may vary, which, in turn, may result in an after-image. In addition, when an image displayed to the pixel is translated from a first image to a second image directly, flickering of the display device may be perceived.

Thus, an exemplary embodiment method may provide that the pixels of an image comprise at least first and second bisected sub-pixels, and that the first and second bisected sub-pixels are displayed with different luminance values corresponding to different gamma curves.

Referring to FIG. 4, a display device according to an exemplary embodiment of the inventive concept includes a plurality of pixels or sub-pixels Px.

The pixels may be driven by a first driving data including a first data which arranges a first image based on the first gamma curve and a second image based on the second gamma curve to each pixel, and a second driving data comprising a second data which arranges the first image and the second image to each pixel with a different arrangement as the first data.

A luminance of the first image based on the first gamma curve is equal to or greater than a luminance of the second image based on the second gamma curve.

The pixels may display an image on a frame set basis. In addition, the frame set may include a first frame I FRAME configured to display the first image to a first pixel A and display the second image to a second pixel B according to the first driving data, a second frame II FRAME configured to display the second image to the first pixel A and display the first image to the second pixel B according to the second driving data and a plurality of transition frames x FRAME disposed between the first frame and the second frame and configured to display a third image and a fourth image to the first pixel A and the second pixel B, a luminance of the third image and the fourth image is equal to or less than a luminance of the first image, and equal to or greater than a luminance of the second image.

An arrangement of the first image and the second image in the first frame I FRAME and an arrangement of the first image and the second image in the second frame II FRAME may be opposite each other.

For example, the first image is displayed to the first pixel A and the second image is displayed to the second pixel B in the first frame I FRAME, and the first image is displayed to the second pixel B and the second image is displayed to the first pixel A in the second frame II FRAME. That is, a pixel displaying the first image in the first frame I FRAME displays the second image in the second frame II FRAME. A pixel displaying the second image in the first frame I FRAME displays the first image in the second frame II FRAME.

A plurality of transition frames x FRAME disposed between the first frame I FRAME and the second frame II FRAME.

The transition frames x FRAME may display a third image and a fourth image to the first pixel A and the second pixel B, a luminance of the third image and the fourth image is equal to or less than a luminance of the first image, and equal to or greater than a luminance of the second image.

A gamma value of the third image is defined by the following Equation 1.

$$\gamma_3=(x-n)/x\times GH+n/x\times GL \quad \text{Equation 1}$$

The x is the number of the transition frames, the n is an order of the transition frames, the GH is a gamma value of the first image and the GL is a gamma value of the second image.

A third mage is displayed to the first pixel A in the transition frames x FRAME. A luminance of the third image is equal to or less than a luminance of the first image, and equal to or greater than a luminance of the second image.

For example, the first image is displayed to the first pixel A in the first frame I FRAME, the third mage is displayed to the first pixel A in the transition frames x FRAME and the second image is displayed to the first pixel A in the second frame II FRAME. A luminance of the third image is equal to or less than a luminance of the first image, and equal to or greater than a luminance of the second image. Therefore, a luminance of the first pixel A may be gradually translated from the first frame I FRAME to the second frame II FRAME.

A gamma value of the fourth image is defined by the following Equation 2.

$$\gamma_4=n/x\times GH+(x-n)/x\times GL \quad \text{Equation 2}$$

The x is the number of the transition frames, the n is an order of the transition frames, the GH is a gamma value of the first image and the GL is a gamma value of the second image.

A fourth image is displayed to the second pixel B in the transition frames x FRAME. A luminance of the fourth image is equal to or less than a luminance of the first image, and equal to or greater than a luminance of the second image.

For example, the second image is displayed to the second pixel B in the first frame I FRAME, the fourth mage is displayed to the second pixel B in the transition frames x FRAME and the first image is displayed to the second pixel B in the second frame II FRAME. A luminance of the fourth image is equal to or less than a luminance of the first image, and equal to or greater than a luminance of the second image. Therefore, a luminance of the second pixel B may be gradually translated from the first frame I FRAME to the second frame II FRAME.

Thus, a method of driving display device according to the present inventive concept translates a gamma value of the pixels between the first frame I FRAME and the second frame II FRAME. Thus, a residual voltage of each pixel may be uniform.

Moreover, a method of driving display device according to the present inventive concept includes a plurality of transition frames x FRAME disposed between the first frame I FRAME and the second frame II FRAME. A third image and a fourth image are displayed to the first pixel and the second pixel in the transition frames x FRAME. A luminance of the third image and the fourth image is equal to or less than a luminance of the first image, and equal to or greater than a luminance of the second image. Therefore, a luminance of the pixels may be gradually translated from the first frame I FRAME to the second frame II FRAME. Thus, flickering of the display device may be substantially prevented.

Figure 5:
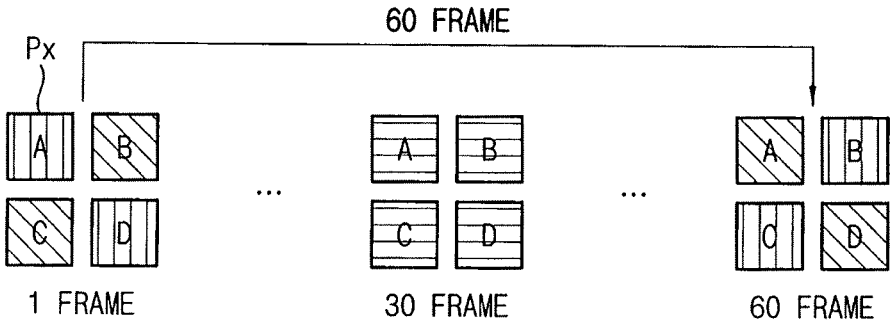
FIG. 5 is a diagram illustrating a luminance of transition frames of pixels of a display device according to an exemplary embodiment of the inventive concept.

FIG. 5 is a view illustrating a luminance of transition frames of pixels of a display device according to an exemplary embodiment of the inventive concept.

Referring to FIG. 5, transition frames x FRAME according to an exemplary embodiment of the inventive concept may include 60 frames.

The third image is displayed to the first pixel A and the fourth image is displayed to the second pixel B in a first frame 1FRAME of the transition frames x FRAME. A luminance of the third image and the fourth image is equal to or less than a luminance of the first image, and equal to or greater than a luminance of the second image.

A gamma value of the third image is defined by the Equation 1. For example, a gamma value of the third image in a first frame 1FRAME may be 59/60×GH+1/60×GL. A gamma value of the third image in a 30-th frame 30 FRAME may be 30/60×GH+30/60×GL. A gamma value of the third image displayed to the first pixel A may be the same as a gamma value of the third image displayed to the second pixel B in the 30-th frame 30 FRAME.

In addition, a gamma value of the fourth image is defined by the Equation 2. For example, a gamma value of the fourth image in a first frame 1FRAME may be 1/60×GH+59/60×GL. A gamma value of the fourth image in a 30-th frame 30 FRAME may be 30/60×GH+30/60×GL. A gamma value of the fourth image displayed to the first pixel A may be the same as a gamma value of the third image displayed to the second pixel B in the 30-th frame 30 FRAME.

In the present exemplary embodiment, a method of driving display device includes 60 transition frames x FRAME disposed between the first frame I FRAME and the second frame II FRAME. A third image and a fourth image are displayed to the first pixel and the second pixel in the transition frames x FRAME. A luminance of the third image and the fourth image is equal to or less than a luminance of the first image, and equal to or greater than a luminance of the second image. Therefore, a luminance of the pixels may be gradually translated from the first frame I FRAME to the second frame II FRAME. Thus, flickering of the display device may be substantially prevented.

Figure 6:
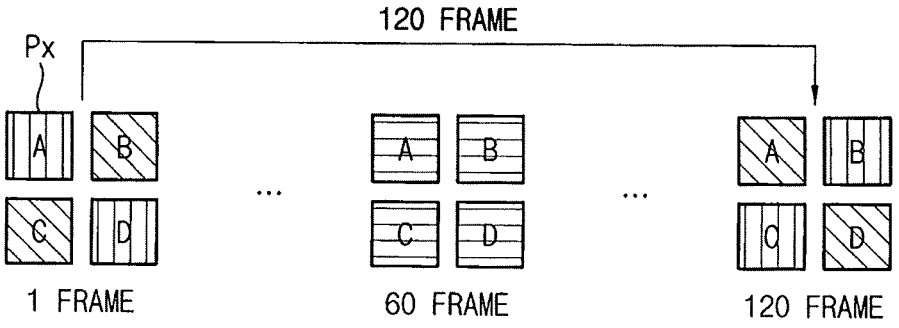
FIG. 6 is a diagram illustrating a luminance of transition frames of pixels of a display device according to an exemplary embodiment of the inventive concept.

FIG. 6 is a view illustrating a luminance of transition frames of pixels of a display device according to an exemplary embodiment of the inventive concept.

Referring to FIG. 6, transition frames x FRAME according to an exemplary embodiment of the inventive concept may include 120 frames.

The third image is displayed to the first pixel A and the fourth image is displayed to the second pixel B in a first frame 1FRAME of the transition frames x FRAME. A luminance of the third image and the fourth image is equal to or less than a luminance of the first image, and equal to or greater than a luminance of the second image.

A gamma value of the third image is defined by the Equation 1. For example, a gamma value of the third image in a first frame 1FRAME may be 119/120×GH+1/120×GL. A gamma value of the third image in a 60-th frame 60 FRAME may be 60/120×GH+60/120×GL. A gamma value of the third image displayed to the first pixel A may be the same as a gamma value of the third image displayed to the second pixel B in the 60-th frame 60 FRAME.

In addition, a gamma value of the fourth image is defined by the Equation 2. For example, a gamma value of the fourth image in a first frame 1FRAME may be 1/120×GH+119/120×GL. A gamma value of the fourth image in a 60-th frame 60 FRAME may be 60/120×GH+60/120×GL. A gamma value of the fourth image displayed to the first pixel A may be the same as a gamma value of the third image displayed to the second pixel B in the 60-th frame 60 FRAME.

In the present exemplary embodiment, a method of driving display device includes 120 transition frames x FRAME disposed between the first frame I FRAME and the second frame II FRAME. A third image and a fourth image are displayed to the first pixel and the second pixel in the transition frames x FRAME. A luminance of the third image and the fourth image is equal to or less than a luminance of the first image, and equal to or greater than a luminance of the second image. Therefore, a luminance of the pixels may be gradually translated from the first frame I FRAME to the second frame II FRAME. Thus, flickering of the display device may be substantially prevented.

Figure 7:
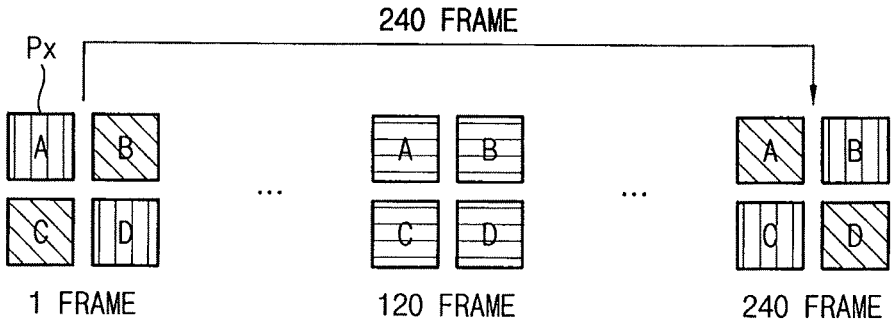
FIG. 7 is a diagram illustrating a luminance of transition frames of pixels of a display device according to an exemplary embodiment of the inventive concept.

FIG. 7 is a view illustrating a luminance of transition frames of pixels of a display device according to an exemplary embodiment of the inventive concept.

Referring to FIG. 7, transition frames x FRAME according to an exemplary embodiment of the inventive concept may include 240 frames.

The third image is displayed to the first pixel A and the fourth image is displayed to the second pixel B in a first frame 1FRAME of the transition frames x FRAME. A luminance of the third image and the fourth image is equal to or less than a luminance of the first image, and equal to or greater than a luminance of the second image.

A gamma value of the third image is defined by the Equation 1. For example, a gamma value of the third image in a first frame 1FRAME may be 239/240×GH+1/240×GL. A gamma value of the third image in a 120-th frame 120 FRAME may be 120/240×GH+120/240×GL. A gamma value of the third image displayed to the first pixel A may be the same as a gamma value of the third image displayed to the second pixel B in the 120-th frame 120 FRAME.

In addition, a gamma value of the fourth image is defined by the Equation 2. For example, a gamma value of the fourth image in a first frame 1FRAME may be 1/240×GH+236/240×GL. A gamma value of the fourth image in a 120-th frame 120 FRAME may be 120/240×GH+120/240×GL. A gamma value of the fourth image displayed to the first pixel A may be the same as a gamma value of the third image displayed to the second pixel B in the 120-th frame 120 FRAME.

In the present exemplary embodiment, a method of driving display device includes 240 transition frames x FRAME disposed between the first frame I FRAME and the second frame II FRAME. A third image and a fourth image are displayed to the first pixel and the second pixel in the transition frames x FRAME. A luminance of the third image and the fourth image is equal to or less than a luminance of the first image, and equal to or greater than a luminance of the second image. Therefore, a luminance of the pixels may be gradually translated from the first frame I FRAME to the second frame II FRAME. Thus, flickering of the display device may be substantially prevented.

Thus, an exemplary embodiment method of displaying an image may include displaying pixels using first luminance values based on a gamma curve corresponding in a first order to the pixels, displaying the pixels using incremental luminance values based on incremental differences between the first luminance values and second luminance values based on the gamma curves corresponding in a second order to the pixels, and displaying the pixels using the second luminance values.

Figure 8:
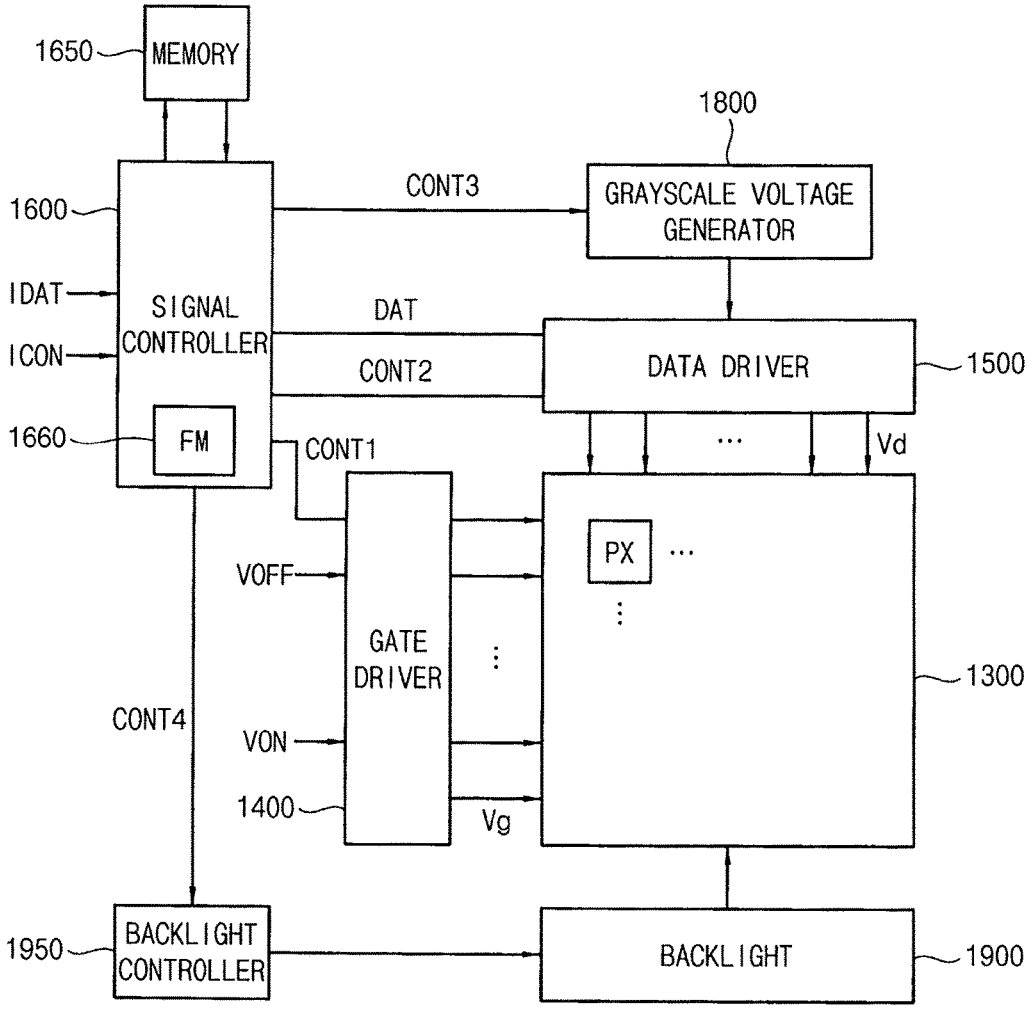
FIG. 8 is a block diagram illustrating a display device according to an exemplary embodiment of the inventive concept.

FIG. 8 is a block diagram illustrating a display device according to an exemplary embodiment of the inventive concept.

Referring to FIG. 8, a display device according to an exemplary embodiment of the inventive concept includes a display panel 1300, a gate driver 1400 and a data driver 1500, each of which is connected to the display panel 1300, a gray voltage generator 1800 connected to the data driver 1500, a signal controller 1600 that controls the gate driver 1400, the data driver 1500 and the gray voltage generator 1800, and a memory 1650 connected to the signal controller 1600.

In an exemplary embodiment, the display panel 1300 includes a plurality of signal lines, and a plurality of pixels PX connected to the signal lines and arranged substantially in a matrix form. In an exemplary embodiment, where the display device is a liquid crystal display, the display panel 1300 includes lower and upper panels (not shown) facing each other and a liquid crystal layer (not shown) interposed therebetween, when viewed from a cross-sectional view.

The signal lines include a plurality of gate lines (not shown) that transmit a gate signal (referred to as a "scanning signal") and a plurality of data lines (not shown) that transmit a data voltage.

The gate driver 1400 is connected to the gate lines and applies a gate signal Vg having a gate-on voltage Von and a gate-off voltage Voff to the gate lines.

The memory 1650 is connected to the signal controller 1600, and stores a gamma data for a gamma curve and then transmits the gamma data to the signal controller 1600. The gamma curve is a curved line of a luminance or a transmittance for the grayscale levels of the input image signal IDAT, and gray voltages or reference gray voltages may be determined based on the gamma curve. The gamma data stored in the memory 1650 may include gamma data for two different gamma curves. In an alternative exemplary embodiment, the memory 1650 may be included in the signal controller 1600 or the gray voltage generator 1800, or in the data driver 1500.

The gray voltage generator 1800 generates gray voltages for all grayscale levels or a predetermined number of gray voltages (hereinafter referred to as "reference gray voltages") related to transmittance of the pixels PX. The (reference) gray voltages may be positive or negative with respect to the common voltage. The gray voltage generator 1800 may receive the gamma data from the signal controller 1600 and generate the (reference) gray voltages based on the gamma data.

In an alternative exemplary embodiment of the inventive concept, the gray voltage generator 1800 may be included in the data driver 1500.

The data driver 1500 is connected to the data line, selects a gray voltage among the gray voltages from the gray voltage generator 1800, and applies the selected gray voltage to the data line as a data signal. In an exemplary embodiment, where the gray voltage generator 1800 does not provide the gray voltage for all grayscale levels, but provides the predetermined number of reference gray voltages, the data driver 1500 may generate gray voltages for all gray levels by dividing the reference gray voltages and then select a data signal among the divided reference gray voltages.

The signal controller 1600 controls an operation of drivers, e.g., the gate driver 1400 and the data driver 1500, for example. The signal controller 1600 may further include a frame memory ("FM") 1660 that stores the input image signal IDAT by a frame unit.

As shown in FIG. 8, an alternative exemplary embodiment of the display device according to the inventive concept may further include a backlight unit 1900 and a backlight controller 1950 that provides light to the display panel 1300.

The backlight controller 1950 receives a backlight control signal CONT4 from the signal controller 1600 to control the backlight unit 1900. The backlight control signal CONT4 may include a pulse width modulation ("PWM") control signal for controlling a turn-on time of the partial or entire backlight unit 1900.

Hereinafter, a display operation of the display device according to an exemplary embodiment of the inventive concept will be described.

The signal controller 1600 receives an input image signal IDAT and an input control signal ICON for controlling display of an image corresponding to the input image signal IDAT from the outside. The input image signal IDAT has luminance information of each pixel PX, and the luminance corresponds to a predetermined number of grayscale levels, for example $1024=2^{10}$, $256=2^{8}$, or $64=2^{6}$. In an exemplary embodiment, the input control signal ICON may include a vertical synchronization signal, a horizontal synchronizing signal, a main clock signal and a data enable signal, for example.

The signal controller 1600 processes the input image signal IDAT based on the input image signal IDAT and the input control signal ICON to convert the input image signal IDAT into an output image signal DAT, and generates a gate control signal CONT1, a data control signal CONT2 and a gamma control signal CONT3. The signal controller 1600 outputs the gate control signal CONT1 to the gate driver 1400, the data control signal CONT2 and the output image signal DAT to the data driver 1500, and the gamma control signal CONT3 to the gray voltage generator 1800.

The gamma control signal CONT3 may include the gamma data stored in the memory 1650.

As shown in FIG. 8, in an exemplary embodiment, where the display device further includes the backlight unit 1900 and the backlight controller 1950, the signal controller 1600 further generates and outputs a backlight control signal CONT4 to the backlight controller 1950.

The gray voltage generator 1800 generates and outputs the gray voltages or the predetermined number of reference gray voltages to the data driver 1500 based on the gamma control signal CONT3. The gray voltages may be respectively provided for the different gamma curves, and the gray voltages may be generated for a gamma curve selected through a separate process.

The data driver 1500 receives the output image data DAT, which may be in a digital form for the pixels PX of a pixel row based on the data control signal CONT2 from the signal controller 1600 and selects the gray voltage corresponding to each output image data DAT to convert the output image data DAT into the analog data voltage Vd, and then applies the converted analog data voltage to the corresponding data lines.

The gate driver 1400 applies the gate-on voltage Von to the gate lines based on the gate control signal CONT1 from the signal controller 1600 to turn on the switching element connected to the gate lines. The data voltage supplied to the data lines is supplied to a corresponding pixel PX through the turned-on switching element. When the pixel PX is applied with the data voltage, the pixel PX may display the luminance corresponding to the data voltage through various optical conversion elements. In one exemplary embodiment, for example, where the display device is the liquid crystal display, an inclination decree of the liquid crystal molecules of the liquid crystal layer is controlled to control polarization of light, thereby displaying the luminance corresponding to the grayscale level of the input image signal IDAT. In such an embodiment, the partial or entire backlight unit 1900 is turned on or turned off based on the control of the backlight controller 1950, thereby providing light to the display panel 1300.

By repeating the process described above, which is a process in a unit of one horizontal period (also written as "1H" and that is the same as one period of the horizontal synchronizing signal and the data enable signal), the gate-on voltage Von is sequentially applied to the plurality of gate lines to apply the data signal to the plurality of pixels PX, thereby displaying images of one frame.

When one frame ends, the next frame starts, and a state of the inversion signal applied to the data driver 1500 may be controlled such that the polarity of the data signal applied to each pixel PX is inverted, e.g., changed to be opposite to a polarity of the previous frame ("frame inversion"). The polarity of the data voltage Vd applied to all pixels PX may be inverted every at least one frame in the frame inversion. In an exemplary embodiment, the polarity of the image data voltage flowing through one of the data lines is changed based on the characteristic of the inversion signal even in one frame, or the polarities of the data voltage Vd applied to the data lines of one pixel PX row may be different from each other.

Figure 9:
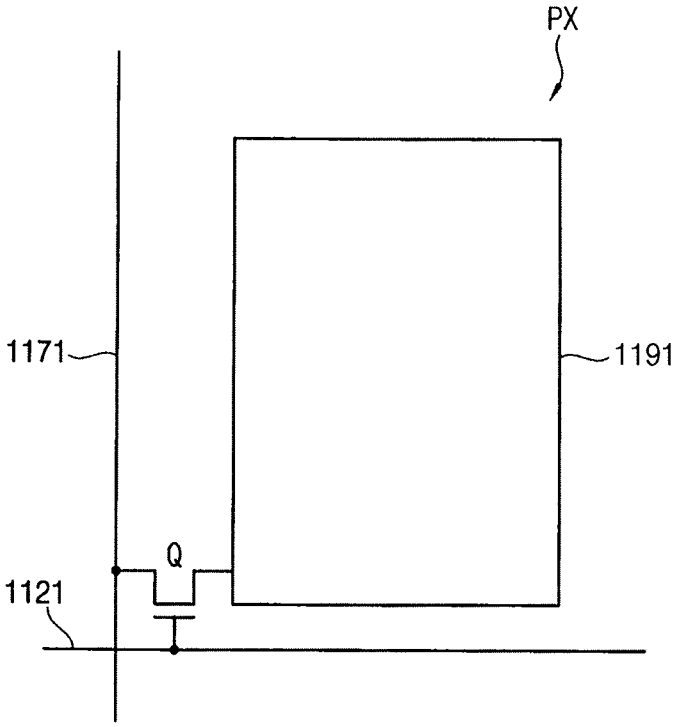
FIG. 9 is a circuit diagram illustrating a pixel of a display device according to an exemplary embodiment of the inventive concept.
Figure 10:
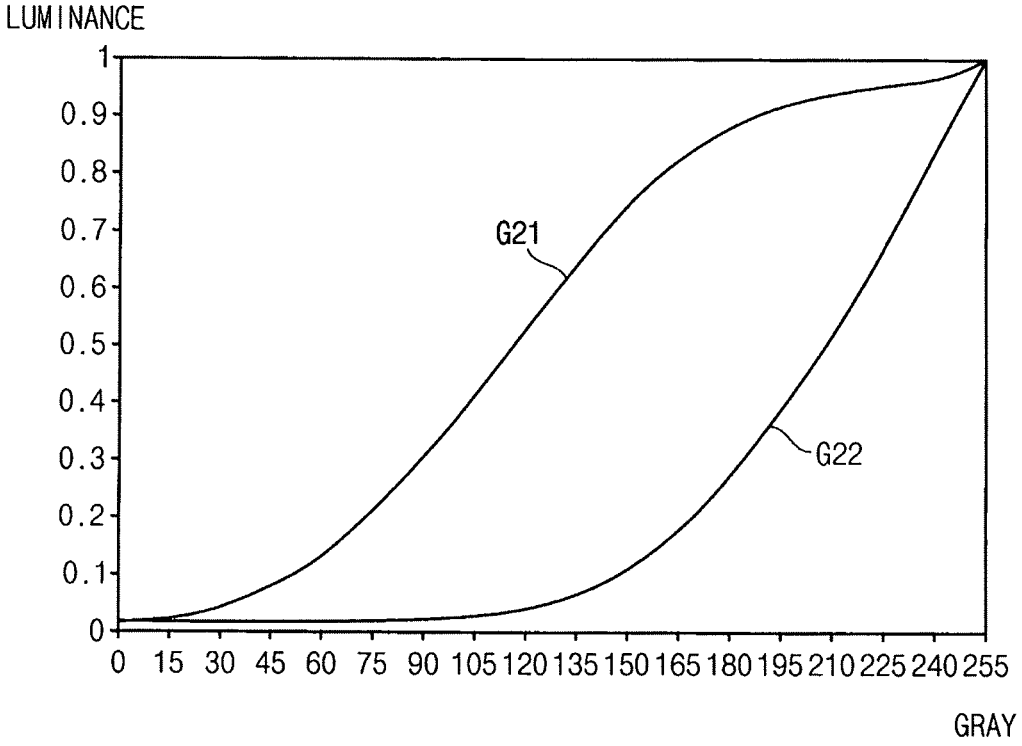
FIG. 10 is a graphical diagram illustrating a gamma curve of a display device according to an exemplary embodiment of the inventive concept.

FIG. 9 is a circuit diagram illustrating a pixel of a display device according to an exemplary embodiment of the inventive concept. FIG. 10 is a graph illustrating a gamma curve of a display device according to an exemplary embodiment of the inventive concept.

Referring to FIG. 9, a pixel PX of an exemplary embodiment of the display device according to the inventive concept may include a switching element Q connected to a data line, e.g., a data line 1171, and at least one gate line, e.g., a gate line 1121, and a pixel electrode 1191 connected to the switching element Q.

The switching element Q may include a thin film transistor, and is controlled according to the gate signal Vg transmitted by the gate line 1121, thereby transmitting the data voltage Vd transmitted by the data line 1171 to the pixel electrode 1191.

In an exemplary embodiment, referring to FIG. 10, the gamma data may include the gamma data for the first gamma curve G21 and the second gamma curve G22. In such an embodiment, the luminance of the image based on the first gamma curve G21 may be equal to or higher than the luminance of the image based on the second gamma curve G22.

Figure 11:
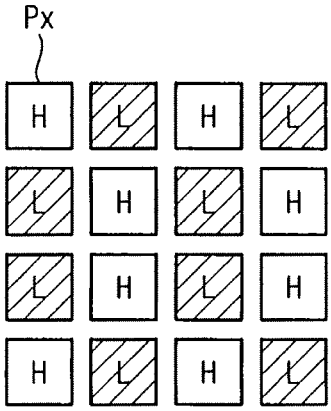
FIG. 11 is a diagram illustrating pixels driven by a first driving data according to an exemplary embodiment of the inventive concept.
Figure 12:
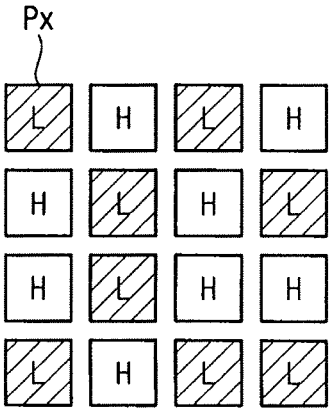
FIG. 12 is a diagram illustrating pixels driven by a second driving data according to an exemplary embodiment of the inventive concept.

FIG. 11 is a view illustrating pixels driven by a first driving data according to an exemplary embodiment of the inventive concept. FIG. 12 is a view illustrating pixels driven by a second driving data according to an exemplary embodiment of the inventive concept.

Referring to FIG. 11, pixels of a display device according to an exemplary embodiment of the inventive concept display an image by using a first driving data. The first driving data includes a first data which arranges a first image based on the first gamma curve and a second image based on the second gamma curve to each pixel.

Referring to FIG. 12, pixels of a display device according to an exemplary embodiment of the inventive concept display an image by using a second driving data. The second driving data includes a second data which arranges the first image and the second image to each pixel with a different arrangement as the first data.

The pixels of a display device according to an exemplary embodiment of the inventive concept may display an image by using the first driving data. The first driving data includes a first data which arranges a first image based on the first gamma curve and a second image based on the second gamma curve to each pixel. A luminance of the first image may be equal to or greater than a luminance of the second image. As shown in FIG. 11, the first image and the second image may be arranged to each pixel randomly.

In addition, the pixels of a display device according to an exemplary embodiment of the inventive concept may display an image by using the second driving data. The second driving data includes a second data which arranges the first image and the second image to each pixel with a different arrangement as the first data. A luminance of the first image may be equal to or greater than a luminance of the second image. As shown in FIG. 12, the first image and the second image may be arranged to each pixel randomly.

In the present exemplary embodiment, the pixels are driven by a first driving data. In addition, after the display panel has been off, when the display panel is on, the pixels are driven by a second driving data. The first driving data and the second driving data include a first data and a second data which arrange a first image based on the first gamma curve and a second image based on the second gamma curve to each pixel randomly.

That is, an arrangement of the first image and the second image based on the first driving data is different from an arrangement of the first image and the second image based on the second driving data. Thus, the pixels are driven by a first driving data. And then, after the display panel has been off, when the display panel is on again, the pixels are driven by a second driving data.

Therefore, whenever the display panel has been off, an arrangement of the first image and the second image to each pixel may be varied. Since an arrangement of the first image and the second image to each pixel is varied, each pixel does not display the same image for too long a time. Thus, a residual voltage of each pixel may be uniform.

Thus, an exemplary embodiment method may include storing an indicator of the prior gamma curves for displaying luminosities of image pixels prior to turning the display off, retrieving the indicator upon turning the display on, and implementing current gamma curves for displaying luminosities of the image pixels based on the retrieved indicator that are different from the prior luminosities.

Figure 13:
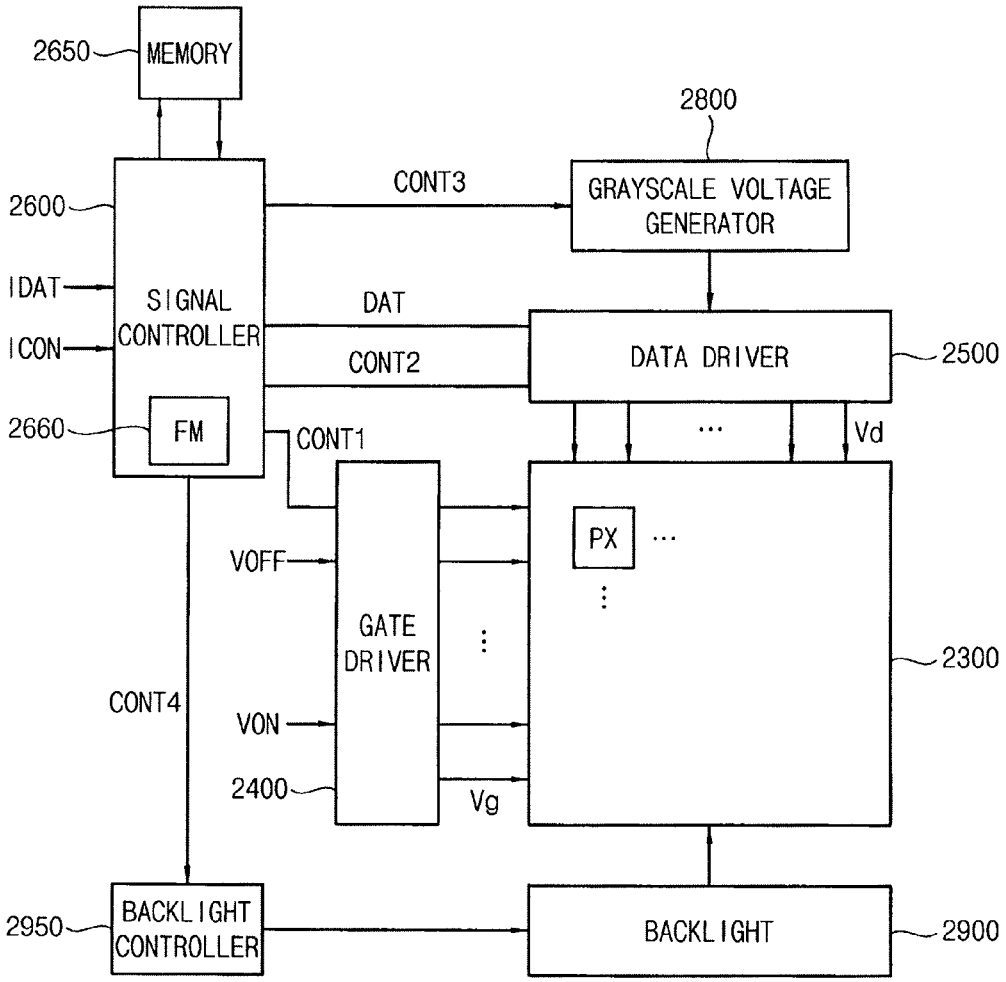
FIG. 13 is a block diagram illustrating a display device according to an exemplary embodiment of the inventive concept.

FIG. 13 is a block diagram illustrating a display device according to an exemplary embodiment of the inventive concept.

Referring to FIG. 13, a display device according to an exemplary embodiment of the inventive concept includes a display panel 2300, a gate driver 2400 and a data driver 2500, each of which is connected to the display panel 2300, a gray voltage generator 2800 connected to the data driver 2500, a signal controller 2600 that controls the gate driver 2400, the data driver 2500 and the gray voltage generator 2800, and a memory 2650 connected to the signal controller 2600.

In an exemplary embodiment, the display panel 300 includes a plurality of signal lines, and a plurality of pixels PX connected to the signal lines and arranged substantially in a matrix form. In an exemplary embodiment, where the display device is a liquid crystal display, the display panel 2300 includes lower and upper panels (not shown) facing each other and a liquid crystal layer (not shown) interposed therebetween, when viewed from a cross-sectional view.

The signal lines include a plurality of gate lines (not shown) that transmit a gate signal (referred to as a "scanning signal") and a plurality of data lines (not shown) that transmit a data voltage.

The gate driver 2400 is connected to the gate lines and applies a gate signal Vg having a gate-on voltage Von and a gate-off voltage Voff to the gate lines.

The memory 2650 is connected to the signal controller 2600, and stores a gamma data for a gamma curve and then transmits the gamma data to the signal controller 2600. The gamma curve is a curved line of a luminance or a transmittance for the grayscale levels of the input image signal IDAT, and gray voltages or reference gray voltages may be determined based on the gamma curve. The gamma data stored in the memory 2650 may include gamma data for two different gamma curves. In an alternative exemplary embodiment, the memory 2650 may be included in the signal controller 2600 or the gray voltage generator 2800, or in the data driver 2500.

The gray voltage generator 2800 generates gray voltages for all grayscale levels or a predetermined number of gray voltages (hereinafter referred to as "reference gray voltages") related to transmittance of the pixels PX. The (reference) gray voltages may be positive or negative with respect to the common voltage. The gray voltage generator 2800 may receive the gamma data from the signal controller 2600 and generate the (reference) gray voltages based on the gamma data.

In an alternative exemplary embodiment of the inventive concept, the gray voltage generator 2800 may be included in the data driver 2500.

The data driver 2500 is connected to the data line, selects a gray voltage among the gray voltages from the gray voltage generator 2800, and applies the selected gray voltage to the data line as a data signal. In an exemplary embodiment, where the gray voltage generator 2800 does not provide the gray voltage for all grayscale levels, but provides the predetermined number of reference gray voltages, the data driver 2500 may generate gray voltages for all gray levels by dividing the reference gray voltages and then select a data signal among the divided reference gray voltages.

The signal controller 2600 controls an operation of drivers, e.g., the gate driver 2400 and the data driver 2500, for example. The signal controller 2600 may further include a frame memory ("FM") 2660 that stores the input image signal IDAT by a frame unit.

As shown in FIG. 13, an alternative exemplary embodiment of the display device according to the inventive concept may further include a backlight unit 2900 and a backlight controller 2950 that provides light to the display panel 2300.

The backlight controller 2950 receives a backlight control signal CONT4 from the signal controller 2600 to control the backlight unit 2900. The backlight control signal CONT4 may include a pulse width modulation ("PWM") control signal for controlling a turn-on time of the partial or entire backlight unit 2900.

Hereinafter, a display operation of the display device according to an exemplary embodiment of the inventive concept will be described.

The signal controller 2600 receives an input image signal IDAT and an input control signal ICON for controlling display of an image corresponding to the input image signal IDAT from the outside. The input image signal IDAT has luminance information of each pixel PX, and the luminance corresponds to a predetermined number of grayscale levels, for example $1024=2^{10}$, $256=2^{8}$, or $64=2^{6}$. In an exemplary embodiment, the input control signal ICON may include a vertical synchronization signal, a horizontal synchronizing signal, a main clock signal and a data enable signal, for example.

The signal controller 2600 processes the input image signal IDAT based on the input image signal IDAT and the input control signal ICON to convert the input image signal IDAT into an output image signal DAT, and generates a gate control signal CONT1, a data control signal CONT2 and a gamma control signal CONT3. The signal controller 2600 outputs the gate control signal CONT1 to the gate driver 2400, the data control signal CONT2 and the output image signal DAT to the data driver 2500, and the gamma control signal CONT3 to the gray voltage generator 2800.

The gamma control signal CONT3 may include the gamma data stored in the memory 2650.

As shown in FIG. 13, in an exemplary embodiment, where the display device further includes the backlight unit 2900 and the backlight controller 2950, the signal controller 2600 further generates and outputs a backlight control signal CONT4 to the backlight controller 2950.

The gray voltage generator 2800 generates and outputs the gray voltages or the predetermined number of reference gray voltages to the data driver 2500 based on the gamma control signal CONT3. The gray voltages may be respectively provided for the different gamma curves, and the gray voltages may be generated for a gamma curve selected through a separate process.

The data driver 2500 receives the output image data DAT, which may be in a digital form for the pixels PX of a pixel row based on the data control signal CONT2 from the signal controller 2600 and selects the gray voltage corresponding to each output image data DAT to convert the output image data DAT into the analog data voltage Vd, and then applies the converted analog data voltage to the corresponding data lines.

The gate driver 2400 applies the gate-on voltage Von to the gate lines based on the gate control signal CONT1 from the signal controller 2600 to turn on the switching element connected to the gate lines. The data voltage supplied to the data lines is supplied to a corresponding pixel PX through the turned-on switching element. When the pixel PX is applied with the data voltage, the pixel PX may display the luminance corresponding to the data voltage through various optical conversion elements. In one exemplary embodiment, for example, where the display device is the liquid crystal display, an inclination decree of the liquid crystal molecules of the liquid crystal layer is controlled to control polarization of light, thereby displaying the luminance corresponding to the grayscale level of the input image signal IDAT. In such an embodiment, the partial or entire backlight unit 2900 is turned on or turned off based on the control of the backlight controller 2950, thereby providing light to the display panel 2300.

By repeating the process described above, which is a process in a unit of one horizontal period (also written as "1H" and that is the same as one period of the horizontal synchronizing signal and the data enable signal), the gate-on voltage Von is sequentially applied to the plurality of gate lines to apply the data signal to the plurality of pixels PX, thereby displaying images of one frame.

When one frame ends, the next frame starts, and a state of the inversion signal applied to the data driver 2500 may be controlled such that the polarity of the data signal applied to each pixel PX is inverted, e.g., changed to be opposite to a polarity of the previous frame ("frame inversion"). The polarity of the data voltage Vd applied to all pixels PX may be inverted every at least one frame in the frame inversion. In an exemplary embodiment, the polarity of the image data voltage flowing through one of the data lines is changed based on the characteristic of the inversion signal even in one frame, or the polarities of the data voltage Vd applied to the data lines of one pixel PX row may be different from each other.

Figure 14:
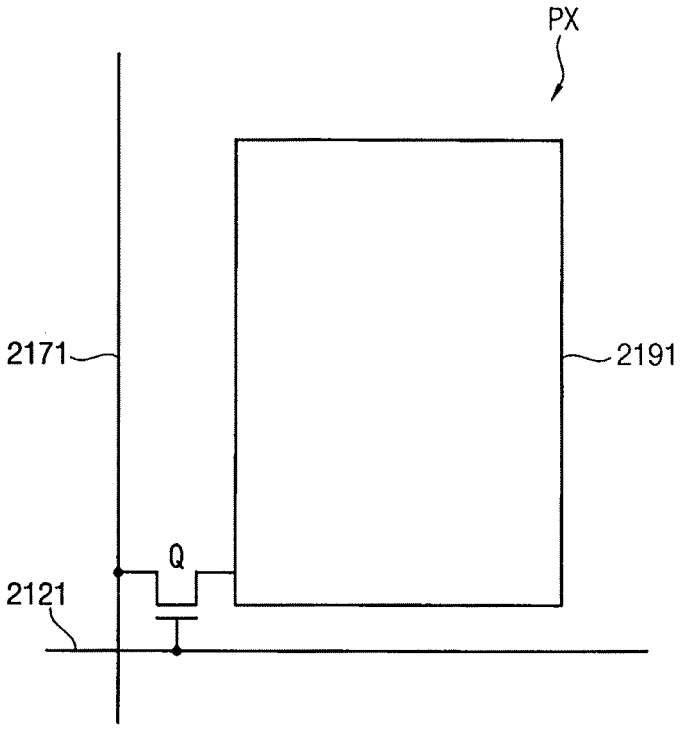
FIG. 14 is a circuit diagram illustrating a pixel of a display device according to an exemplary embodiment of the inventive concept.
Figure 15:
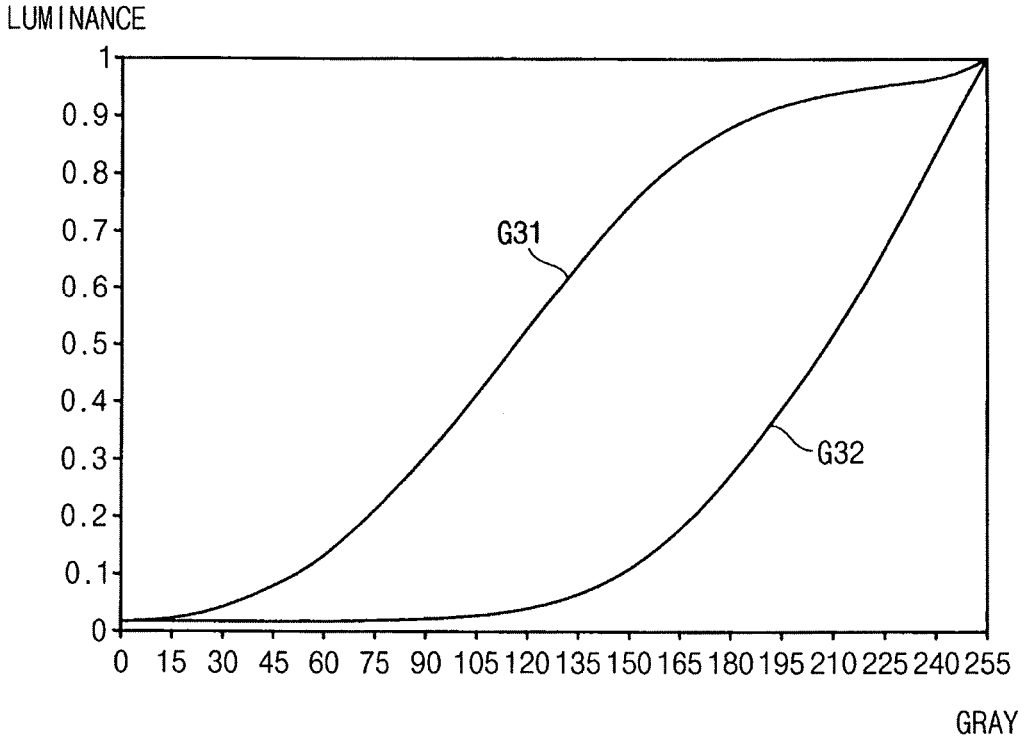
FIG. 15 is a graphical diagram illustrating a gamma curve of a display device according to an exemplary embodiment of the inventive concept.

FIG. 14 is a circuit diagram illustrating a pixel of a display device according to an exemplary embodiment of the inventive concept. FIG. 15 is a graph illustrating a gamma curve of a display device according to an exemplary embodiment of the inventive concept.

Referring to FIG. 14, a pixel PX of an exemplary embodiment of the display device according to the inventive concept may include a switching element Q connected to a data line, e.g., a data line 2171, and at least one gate line, e.g., a gate line 2121, and a pixel electrode 2191 connected to the switching element Q.

The switching element Q may include a thin film transistor, and is controlled according to the gate signal Vg transmitted by the gate line 2121, thereby transmitting the data voltage Vd transmitted by the data line 2171 to the pixel electrode 2191.

In an exemplary embodiment, referring to FIG. 15, the gamma data may include the gamma data for the first gamma curve G31 and the second gamma curve G32. In such an embodiment, the luminance of the image based on the first gamma curve G31 may be equal to or higher than the luminance of the image based on the second gamma curve G32.

Figure 16:
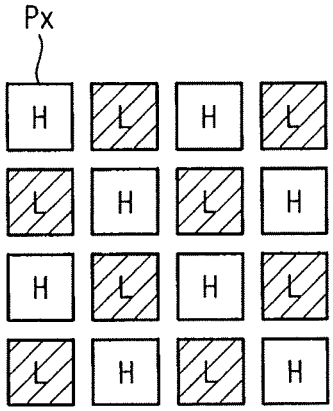
FIG. 16 is a diagram illustrating pixels driven by a first driving data according to an exemplary embodiment of the inventive concept.
Figure 17:
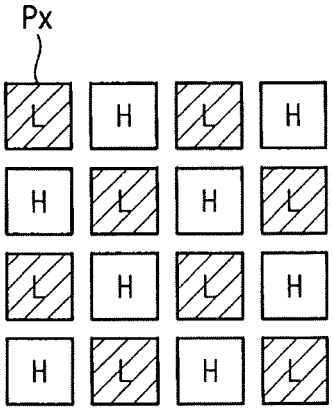
FIG. 17 is a diagram illustrating pixels driven by a second driving data according to an exemplary embodiment of the inventive concept.

FIG. 16 is a view illustrating pixels driven by a first driving data according to an exemplary embodiment of the inventive concept. FIG. 17 is a view illustrating pixels driven by a second driving data according to an exemplary embodiment of the inventive concept.

Referring to FIG. 16, pixels of a display device according to an exemplary embodiment of the inventive concept display an image by using a first driving data. The first driving data includes a first data which arranges a first image based on the first gamma curve and a second image based on the second gamma curve to each pixel.

Referring to FIG. 17, pixels of a display device according to an exemplary embodiment of the inventive concept display an image by using a second driving data. The second driving data includes a second data which arranges the first image and the second image to each pixel with a different arrangement as the first data.

The pixels of a display device according to an exemplary embodiment of the inventive concept may display an image by using the first driving data. The first driving data includes a first data which arranges a first image based on the first gamma curve and a second image based on the second gamma curve to each pixel. A luminance of the first image may be equal to or greater than a luminance of the second image. As shown in FIG. 16, the first image and the second image may be arranged to each pixel alternately.

In addition, the pixels of a display device according to an exemplary embodiment of the inventive concept may display an image by using the second driving data. The second driving data includes a second data which arranges the first image and the second image to each pixel with a different arrangement as the first data. A luminance of the first image may be equal to or greater than a luminance of the second image. As shown in FIG. 17, the first image and the second image may be arranged to each pixel alternately.

An arrangement of the first image and the second image based on the first driving data and an arrangement of the first image and the second image based on the second driving data are opposite.

In the present exemplary embodiment, the pixels are driven by a first driving data. In addition, after the display panel has been off, when the display panel is on again, the pixels are driven by a second driving data. At this time, before the display panel is off, a first data of the first driving data concerning arrangement of the first image and the second image to each pixel is stored. And then, a second driving data comprising a second data which arranges the first image and the second image to each pixel with an opposite arrangement as the first data is generated.

Therefore, after the display panel has been off, when the display panel is on again, the pixels are driven by a second driving data including a second data which arranges the first image and the second image to each pixel with a different arrangement as the first data.

That is, an arrangement of the first image and the second image based on the first driving data is different from an arrangement of the first image and the second image based on the second driving data. Thus, the pixels are driven by a first driving data. And then, after the display panel has been off, when the display panel is on again, the pixels are driven by a second driving data.

Therefore, whenever the display panel has been off, an arrangement of the first image and the second image to each pixel may be varied. Since an arrangement of the first image and the second image to each pixel is varied, each pixel does not display the same image for too long a time. Thus, a residual voltage of each pixel may be uniform.

Figure 18:
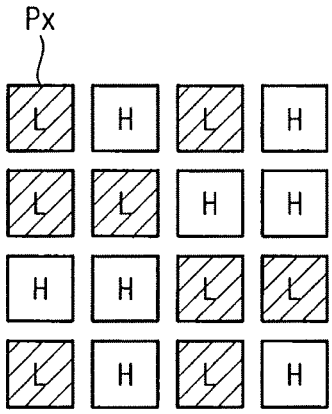
FIG. 18 is a diagram illustrating pixels driven by a first driving data according to an exemplary embodiment of the inventive concept.
Figure 19:
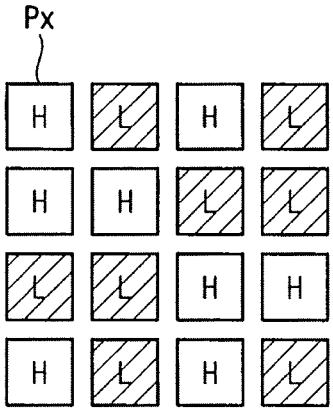
FIG. 19 is a diagram illustrating pixels driven by a second driving data according to an exemplary embodiment of the inventive concept.

FIG. 18 is a view illustrating pixels driven by a first driving data according to an exemplary embodiment of the inventive concept. FIG. 19 is a view illustrating pixels driven by a second driving data according to an exemplary embodiment of the inventive concept.

Referring to FIG. 18, pixels of a display device according to an exemplary embodiment of the inventive concept display an image by using a first driving data. The first driving data includes a first data which arranges a first image based on the first gamma curve and a second image based on the second gamma curve to each pixel.

Referring to FIG. 19, pixels of a display device according to an exemplary embodiment of the inventive concept display an image by using a second driving data. The second driving data includes a second data which arranges the first image and the second image to each pixel with a different arrangement as the first data.

The pixels of a display device according to an exemplary embodiment of the inventive concept may display an image by using the first driving data. The first driving data includes a first data which arranges a first image based on the first gamma curve and a second image based on the second gamma curve to each pixel. A luminance of the first image may be equal to or greater than a luminance of the second image. As shown in FIG. 18, the first image and the second image may be arranged to each pixel randomly.

In addition, the pixels of a display device according to an exemplary embodiment of the inventive concept may display an image by using the second driving data. The second driving data includes a second data which arranges the first image and the second image to each pixel with a different arrangement as the first data. A luminance of the first image may be equal to or greater than a luminance of the second image. As shown in FIG. 19, the first image and the second image may be arranged to each pixel randomly.

An arrangement of the first image and the second image based on the first driving data and an arrangement of the first image and the second image based on the second driving data are opposite.

In the present exemplary embodiment, the pixels are driven by a first driving data. In addition, after the display panel has been off, when the display panel is on, the pixels are driven by a second driving data. At this time, before the display panel is off, a first data of the first driving data concerning arrangement of the first image and the second image to each pixel is stored. And then, a second driving data comprising a second data which arranges the first image and the second image to each pixel with an opposite arrangement as the first data is generated.

Therefore, after the display panel has been off, when the display panel is on, the pixels are driven by a second driving data including a second data which arranges the first image and the second image to each pixel with a different arrangement as the first data.

That is, an arrangement of the first image and the second image based on the first driving data is different from an arrangement of the first image and the second image based on the second driving data. Thus, the pixels are driven by a first driving data. And then, after the display panel has been off, when the display panel is on, the pixels are driven by a second driving data.

Therefore, whenever the display panel has been off, an arrangement of the first image and the second image to each pixel may be varied. Since an arrangement of the first image and the second image to each pixel is varied, each pixel does not display the same image for too long a time. Thus, a residual voltage of each pixel may be uniform.

According to the present exemplary embodiment, a method of driving display device according to the present inventive concept includes a plurality of transition frames disposed between a first frame and a second frame. A third image and a fourth image are displayed to the first pixel and the second pixel in the transition frames. A luminance of the third image and the fourth image is equal to or less than a luminance of the first image, and equal to or greater than a luminance of the second image. Therefore, a luminance of the pixels may be gradually translated from the first frame to the second frame. Thus, flickering of the display device may be substantially prevented.

In addition, the pixels are driven by a first driving data. In addition, after the display panel has been off, when the display panel is on, the pixels are driven by a second driving data.

Therefore, whenever the display panel has been off, an arrangement of the first image and the second image to each pixel may be varied. Since an arrangement of the first image and the second image to each pixel is varied, each pixel does not display the same image long time. Thus, a residual voltage of each pixel may be uniform.

The foregoing is illustrative of the present invention and is not to be construed as limiting thereof. Although exemplary embodiments of the present inventive concept have been described, those of ordinary skill in the pertinent art will readily appreciate that many modifications are possible in the exemplary embodiments without materially departing from the novel teachings and advantages of the present disclosure. Accordingly, all such modifications are intended to be included within the scope of the present invention as set forth in the appended claims. Therefore, it is to be understood that the foregoing is illustrative of the present invention and is not to be construed as limited to the specific exemplary embodiments disclosed, and that modifications to the disclosed exemplary embodiments, as well as other embodiments, are intended to be included within the scope of the appended claims. The present inventive concept is defined by the following claims, with equivalents of the claim elements to be included therein.

What is claimed is:

1. A display device, comprising:

a memory configured to store gamma data corresponding to a plurality of gamma curves including a first gamma curve and a second gamma curve;

a gray voltage generator configured to generate a plurality of gray voltages based on the gamma data;

a signal controller configured to receive an input image signal;

a data driver configured to receive the input image signal from the signal controller and convert the input image signal into a data voltage using the gray voltages; and a display panel comprising a plurality of pixels configured to receive the data voltage and display an image during a frame set, wherein the plurality of pixels are first driven in a first frame of the frame set by first driving data comprising first data which assigns a first image based on the first gamma curve to at least a first of the plurality of pixels and a second image based on the second gamma curve to at least a second of the plurality of pixels, and then driven in a second frame of the frame set by second driving data comprising second data which assigns the first image to at least the second of the plurality of pixels and the second image to at least the first of the plurality of pixels, and Wherein a plurality of transition frames are disposed between the first frame and the second frame, wherein the pixels display an image on a frame set basis, and wherein the first frame of the frame set is configured to display the first image to a first pixel and display the second image to a second pixel according to the first driving data;

the second frame of the frame set is configured to display the second image to the first pixel and display the first image to the second pixel according to the second driving data; and the plurality of transition frames are configured to display a third image and a fourth image to the first pixel and the second pixel, respectively, wherein a luminance of the third image is equal to or less than the luminance of the first image, and a luminance of the fourth image is equal to or greater than the luminance of the second image.

2. The display device of claim 1, wherein a gamma value of the third image is defined by the following expression:

$(x-n)/x \times GH + n/x \times GL$, and a gamma value of the fourth image is defined by the following expression:

$n/x \times GH + (x-n)/x \times GL$, wherein the x is a number of the transition frames, the n is an order of the transition frames, the GH is a gamma value of the first image and the GL is a gamma value of the second image.

3. The display device of claim 2, wherein the number of the transition frames is 60.

4. The display device of claim 2, wherein the number of the transition frames is 120.

5. The display device of claim 2, wherein the number of the transition frames is 240.

6. A method of driving a display device comprising a memory configured to store gamma corresponding to a plurality of gamma curves including a first gamma curve and a second gamma curve, a gray voltage generator configured to generate a plurality of gray voltages based on the gamma data, a signal controller configured to receive an input image signal, a data driver configured to receive the input image signal from the signal controller and convert the input image signal into a data voltage using the gray voltages and a display panel comprising a plurality of pixels configured to receive the data voltages and display an image during a frame set, the method comprising:

displaying an image in a first frame of the frame set according to first driving data comprising first data which assigns a first image based on the first gamma curve to at least a first of the plurality of pixels and a second image based on the second gamma curve to at least a second of the plurality of pixels; and displaying an image in a second frame of the frame set according to second driving data comprising second data which assigns the first image to at least the second of the plurality of pixels and the second image to at least the first of the plurality of pixels, wherein a plurality of transition frames are disposed between the first frame and the second frame, wherein a luminance of the first image is equal to or greater than a luminance of the second image, and wherein the pixels display an image on a frame set basis, and the first frame of the frame set is to display the first image to a first pixel and display the second to a second pixel according to the first driving data;

the second frame of the frame set is configured to display the second image to the first pixel and display the first to the second pixel according to the second driving data; and the plurality of transition frames are configured to display a third image and fourth image to the first pixel and the second pixel, a luminance of the third image and the fourth image is equal to or less than the luminance of the first image, and equal to or greater than the luminance of the second image.

7. The method of claim 6, wherein a gamma value of the third image is defined by the following expression:

$(x-n)/x \times GH + n/x \times GL$, and a gamma value of the fourth image is defined by the following expression:

$n/x \times GH + (x-n)/x \times GL$, wherein the x is a number of the transition frames, the n is an order of the transition frames, the GH is a gamma value of the first image and the GL is a gamma value of the second image.

8. The method of claim 7, wherein the number of the transition frames is 60.

9. The method of claim 7, wherein the number of the transition frames is 120.

10. The method of claim 7, wherein the number of the transition frames is 240.

* * * * *